US006948484B2

(12) United States Patent
Umino et al.

(10) Patent No.: US 6,948,484 B2
(45) Date of Patent: Sep. 27, 2005

(54) CAPACITOR DISCHARGE IGNITION DEVICE

(75) Inventors: Hiroshi Umino, Tokyo (JP); Hideki Umemoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/784,937

(22) Filed: Feb. 25, 2004

(65) Prior Publication Data

US 2005/0066948 A1 Mar. 31, 2005

(30) Foreign Application Priority Data

Sep. 25, 2003 (JP) ..... P2003-333978

(51) Int. Cl.[7] ..... F02P 3/08
(52) U.S. Cl. ..... 123/597; 123/198 D; 324/382
(58) Field of Search ..... 123/596, 597, 123/630, 198 D; 324/382

(56) References Cited

U.S. PATENT DOCUMENTS 4,562,823 A * 1/1986 Moritugu et al. ..... 123/596
5,216,369 A * 6/1993 Toyama ..... 324/390
5,623,209 A * 4/1997 Lepley et al. ..... 342/382
5,970,952 A 10/1999 Mogi et al.
6,222,367 B1 4/2001 Shimizu et al.
6,384,606 B1 * 5/2002 Nussbaum ..... 324/382
6,492,818 B1 * 12/2002 Downs ..... 324/382

FOREIGN PATENT DOCUMENTS

JP 2001-132602 A 5/2001

* cited by examiner

*Primary Examiner*—Tony M. Argenbright
*Assistant Examiner*—Arnold Castro
(74) *Attorney, Agent, or Firm*—Sughrue Mion, PLLC

(57) ABSTRACT

A capacitor discharge ignition device is provided with a capacitor for storing charge to produce ignition energy; ignition coils that receive charge released from the capacitor on the primary side and generate a high voltage on the secondary side; a switching element for causing the capacitor to release the charge stored therein to the ignition coils; ignition timing control means that receives a signal corresponding to a crank angle of an internal combustion engine and supplies an ignition signal to the switching element; and circuit abnormality detecting means that receives a signal from the ignition timing control means, sets a capacitor voltage measurement time, and judges for a circuit abnormality on the basis of a voltage of the capacitor measured at the capacitor voltage measurement time.

6 Claims, 10 Drawing Sheets

CAPACITOR DISCHARGE IGNITION DEVICE

BACKGROUND OF THE INVENTION

1. Field of the Invention

The present invention relates to detection of an abnormality in a capacitor discharge ignition device that is used for igniting an internal combustion engine.

2. Description of the Related Art

In capacitor discharge ignition devices used for igniting an internal combustion engine, a capacitor for ignition is charged to a prescribed voltage before an ignition time and the resulting charge is released to an ignition primary coil at the ignition time, whereby a high voltage is induced across an ignition secondary coil. Therefore, the capacitor has been charged to the prescribed voltage or more at an instant immediately before the ignition time and the voltage of the capacitor decreases and becomes approximately equal to 0 V after the ignition and before a start of charging for the next ignition. If an abnormality such as a disconnection in a discharge circuit exists from the capacitor to the ignition primary coil, charge is not released to the ignition primary coil and hence the internal combustion engine cannot be ignited. The voltage of the capacitor does not decrease even after the ignition time. On the other hand, if an abnormality exists in a charging circuit, the voltage of the capacitor is not increased to the prescribed voltage and hence cannot cause ignition.

Various means for detecting an abnormality location in ignition circuits are known. Most of those means relate to an induction-type ignition device, that is, they detect an abnormality by detecting an ion current in an ignition plug. For example, JP-A-11-13619 (pages 3–6 and FIGS. 1–4) discloses a technique in which an ion current supply means and an ion current measuring means are provided in an ignition secondary circuit. Ion current values are measured in divisional periods obtained by dividing a period from turning-on of an ignition primary circuit to the end of an ignition discharge. Based on the measurement values, the ignition device judges whether a misfire is due to no specific failure or due to a failure in the input system or the unit.

JP-A-2000-199451 (pages 4 and 5 and FIG. 1) discloses a technique in which an ion current is detected for misfire detection. Although this technique is not intended for detection of an abnormality location, it enables detection of a disconnection in an ignition secondary circuit. To prevent leakage of a high voltage to an ion current detection circuit at the occurrence of a disconnection in the ignition secondary circuit, a Zener diode is provided on the low-voltage side of the ignition secondary circuit. JP-A-2001-132602 (pages 2 and 3 and FIGS. 1, 3, and 4) discloses a technique of judging in which of ignition signal lines of a plurality of cylinders a disconnection has occurred by comparing an ignition signal with a voltage drop across a resistor for limiting an output current of the ignition signal.

In the above conventional devices, the methods of detecting an ion current in an cylinder have an advantage that occurrence/non-occurrence of a discharge for ignition and a combustion state in the cylinder can be detected or measured at the same time. However, those methods have problems that the circuit configuration is complex and the device is expensive for the limited purpose of detecting an abnormality in an ignition circuit because, for example, circuits and elements for measurement need to be added and a peak hold circuit needs to be added because of short duration of a phenomenon.

SUMMARY OF THE INVENTION

The present invention has been made to solve the above problems, and an object of the invention is therefore to provide a capacitor discharge ignition device capable of easily detecting an abnormality in an ignition circuit paying attention to the fact that capacitor discharge ignition devices can detect a discharge indirectly by measuring a capacitor voltage.

The invention provides a capacitor discharge ignition device comprising a capacitor that is charged by a power source and stores charge to produce ignition energy; ignition coils that receive charge released from the capacitor on a primary side and generate a high voltage on a secondary side; a switching element for causing the capacitor to release the charge stored therein to the ignition coils; ignition timing control means that receives a signal corresponding to a crank angle of an internal combustion engine and supplies an ignition signal to the switching element; and circuit abnormality detecting means that receives a signal from the ignition timing control means, sets a capacitor voltage measurement time, and judges for a circuit abnormality on the basis of a voltage of the capacitor measured at the capacitor voltage measurement time.

In the capacitor discharge ignition device according to the invention, the circuit abnormality detecting means measures a capacitor voltage with particular timing and judges for a circuit abnormality on the basis of a measured capacitor voltage. Therefore, whether a charging circuit or a discharge circuit has an abnormality such as a disconnection can be judged easily. A failure diagnosis on an ignition device can be performed by a simple circuit configuration.

DESCRIPTION OF THE PREFERRED EMBODIMENTS

Embodiment 1

Figure 1:
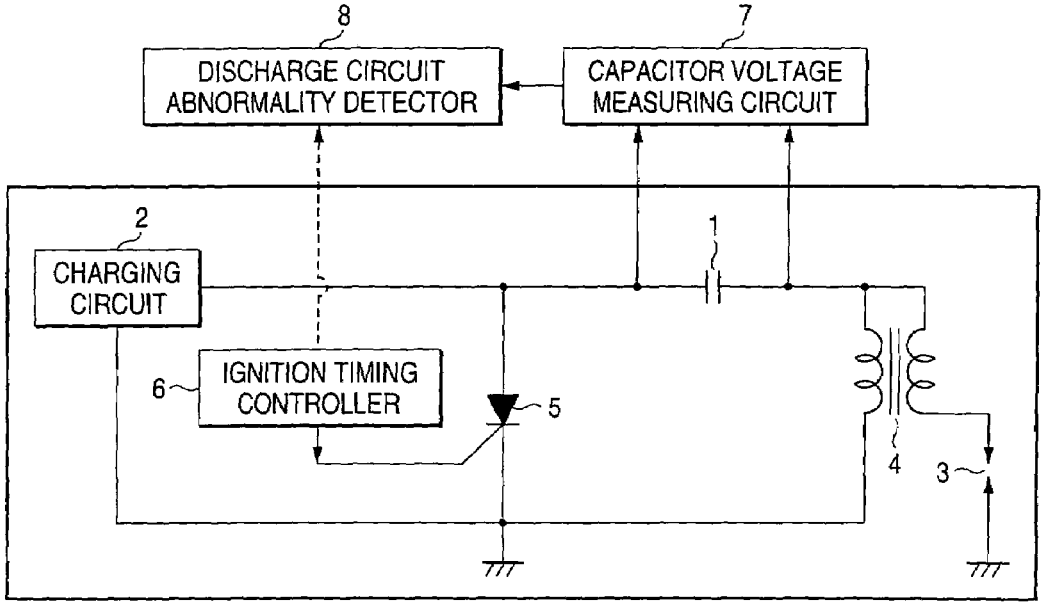
FIG. 1 is a circuit diagram showing the configuration of a capacitor discharge ignition device according to a first embodiment of the present invention.
Figure 2:
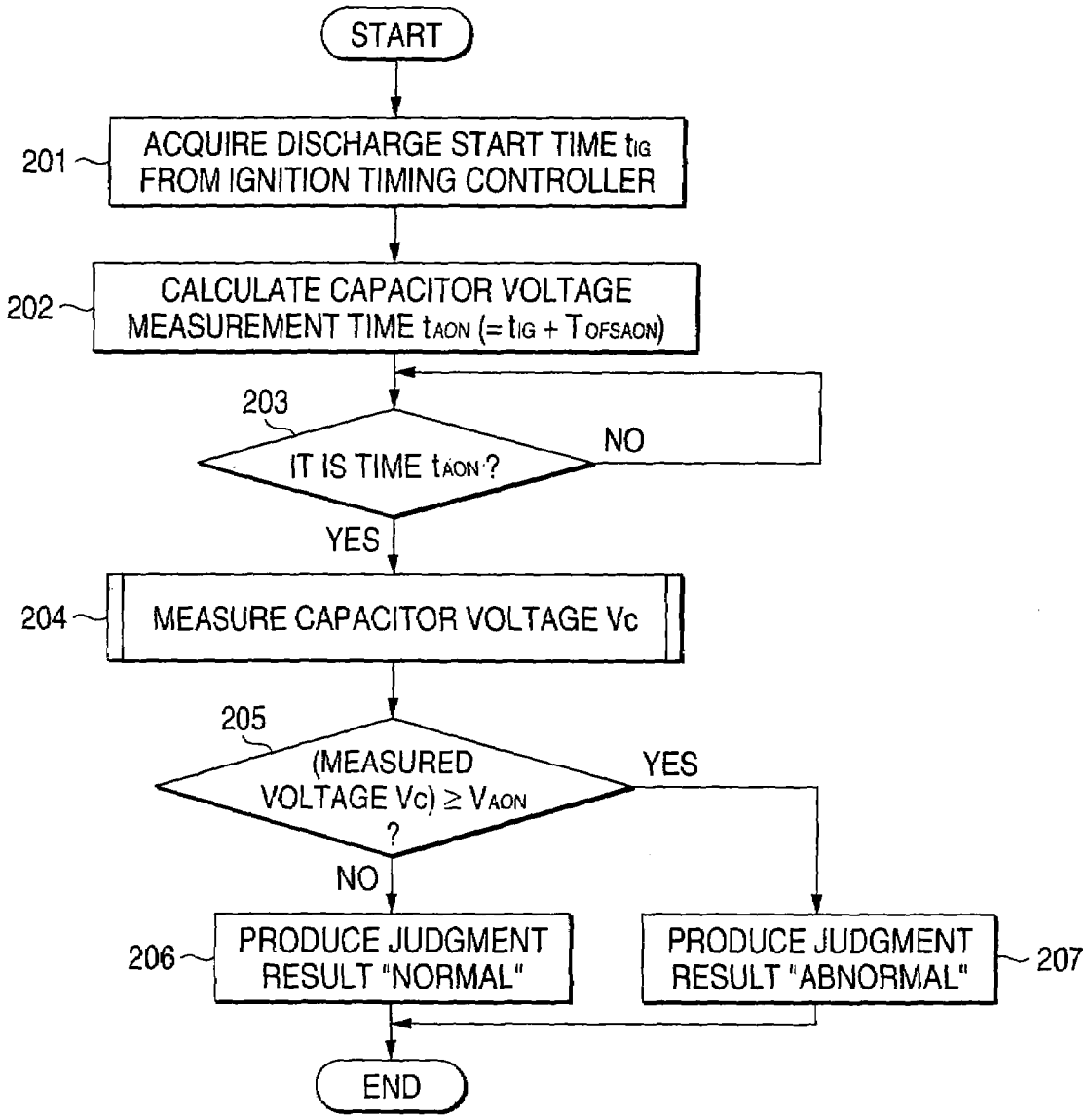
FIGS. 2 and 3 are a flowchart and a time chart, respectively, showing the operation of the capacitor discharge ignition device of FIG. 1.
Figure 3:
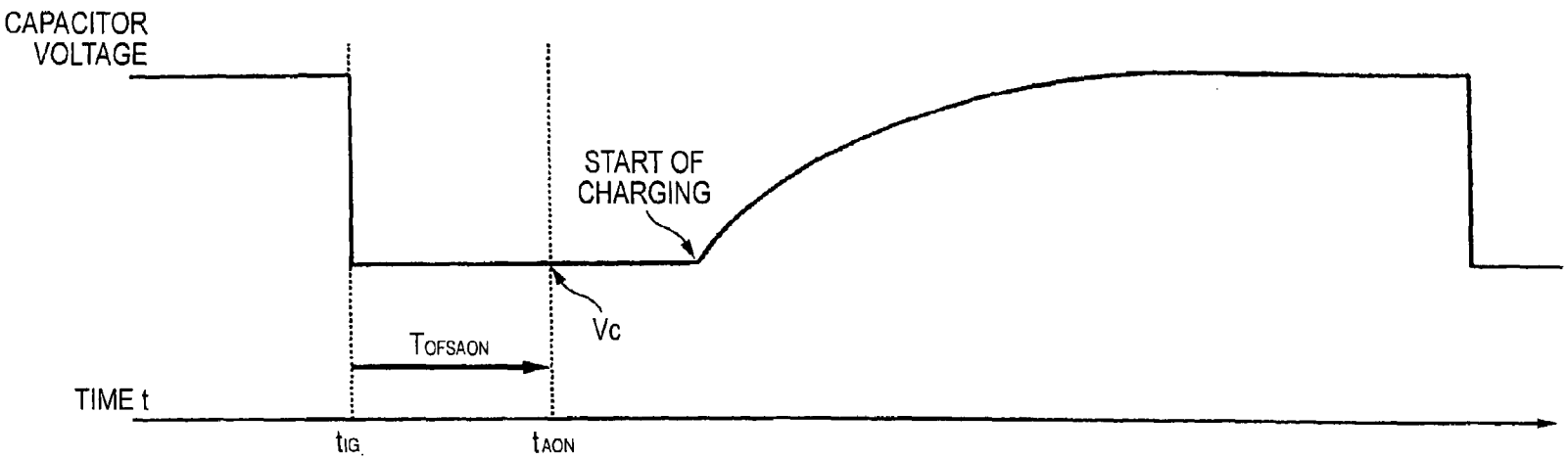

FIGS. 1–3 are for description of a capacitor discharge ignition device according to a first embodiment of the present invention. More specifically, FIG. 1 is a circuit diagram showing the configuration of the capacitor discharge ignition device and FIGS. 2 and 3 are a flowchart and a time chart, respectively, showing its operation. As shown in FIG. 1, the capacitor discharge ignition device according to this embodiment is composed of a capacitor 1 for storing charge to produce ignition energy, a charging circuit 2 as a DC power source for charging the capacitor 1, ignition coils 4 connected to an ignition plug 3, a switching element 5 for supplying the charge stored in the capacitor 1 to the primary side of the ignition coils 4, an ignition timing controller 6 for determining ignition timing on the basis of a received crank angle signal of an internal combustion engine and producing a signal for driving the switching element 5 at an ignition time, a capacitor voltage measuring circuit 7 for measuring the voltage of the capacitor 1, and a discharge circuit abnormality detector 8 for detecting an abnormality in a discharge circuit by receiving the capacitor voltage measured by the capacitor voltage measuring circuit 7 and reading it with particular timing.

In the capacitor discharge ignition device having the above configuration, the charging circuit 2 usually outputs a voltage of at least a hundred volts plus tens of volts and the capacitor 1 is charged by this voltage. The terminal voltage of the capacitor 1 increases as shown in FIG. 3. The ignition timing controller 6 determines ignition timing on the basis of a received rotation speed of the internal combustion engine and other information and supplies an ignition signal to the switching element 5 at an ignition time. The switching element 5 is rendered conductive by the ignition signal, whereupon the charge of the capacitor 1 is released to the primary coil of the ignition coils 4 and a high voltage is induced across the secondary coil of the ignition coils 4. A discharge occurs in the ignition plug 3 and the internal combustion engine is ignited.

After the discharge, the voltage of the capacitor 1 decreases to approximately 0 V. To prepare for the next ignition, charging is started again after a lapse of a predetermined time from the completion of the discharge. The voltage between the two terminals of the capacitor 1 that varies in this manner is monitored by the capacitor voltage measuring circuit 7, and the monitored voltage is input to the discharge circuit abnormality detector 8. The discharge circuit abnormality detector 8 reads the monitored voltage with particular timing, and judges occurrence/non-occurrence of an abnormality in the ignition circuit on the basis of the thus-read voltage. The same signal as the ignition signal that is input to the switching element 5 is input from the ignition timing controller 6 to the discharge circuit abnormality detector 8. On the basis of this signal, the discharge circuit abnormality detector 8 starts a routine and calculates voltage reading timing. This operation will be described below with reference to the flowchart of FIG. 2 and the time chart of FIG. 3.

Upon determining an ignition time on the basis of a crank angle signal of the internal combustion engine, at step 201 the ignition timing controller 6, supplies a signal indicating the ignition time $t_{IG}$ to the discharge circuit abnormality detector 8. At step 202, on the basis of the received signal the discharge circuit abnormality detector 8 calculates a time $t_{AON}$ to measure a voltage of the capacitor 1. The time $t_{AON}$ is a time to detect an abnormality in the discharge circuit. In this embodiment, the time $t_{AON}$ is calculated as $t_{AON}=t_{IG}+T_{OFSAON}$, that is, a time that is a predetermined time after the ignition. Step 203 is to wait for arrival of the time $t_{AON}$. Upon arrival of the time $t_{AON}$, the process goes to step 204, where a voltage Vc of the capacitor 1 is measured. At step 205, the voltage Vc is compared with a judgment reference voltage $V_{AON}$. If the capacitor voltage Vc is lower than the judgment reference voltage $V_{AON}$, the process goes to step 206, where it is judged that the discharge circuit is normal. If the capacitor voltage Vc is higher than or equal to the judgment reference voltage $V_{AON}$, which means that the charge of the capacitor 1 has not sufficiently been released to the ignition coils 4, the process goes to step 207, where it is judged that the discharge circuit has an abnormality such as a disconnection. FIG. 3 shows relationships between the capacitor voltage and the individual time points.

As described above, the judgment as to whether the discharge circuit from the ignition unit including the capacitor 1 to the ignition coils 4 has an abnormality such as a disconnection can be made by measuring a capacitor voltage Vc in the period from the release of the charge of the capacitor 1 to the start of the next charging. A failure diagnosis can be performed by the simple circuit configuration. The waiting time $T_{OFSAON}$ for the measurement of the voltage of the capacitor 1 is determined by the configuration of the ignition circuit. It is ideal that the waiting time $T_{OFSAON}$ be set to a time from the completion of a discharge of the capacitor 1 to the start of the next charging. The waiting time $T_{OFSAON}$ is determined so as to reflect the characteristics of the ignition circuit.

The capacitor voltage judgment reference voltage $V_{AON}$ is determined as a post-discharge voltage by the configuration of the ignition device, and may be a fixed value depending on the characteristics of the charging circuit 2 or a variable that varies with the rotation speed of the internal combustion engine. In the latter case, the voltage $V_{AON}$, which is a function of the rotation speed of the internal combustion engine, can be set by calculating the rotation speed on the basis of such information as the crank angle that is input to the ignition timing controller 6. For example, even if a voltage measurement time cannot be set in the period to the start of the next charging, that is, it is set to an instant immediately after the start of the next charging, a correct judgment can be made by setting a voltage $V_{AON}$ properly on the basis of the measurement time and a rotation speed.

Embodiment 2

Figure 4A:
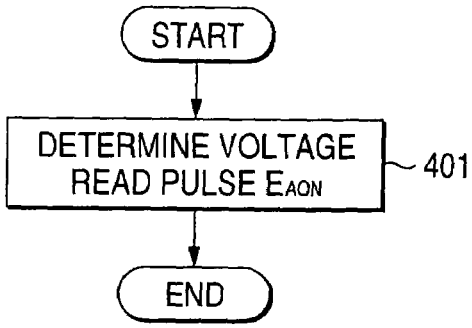
FIGS. 4A and 4B and FIG. 5 are flowcharts and a time chart, respectively, showing the operation of a capacitor discharge ignition device according to a second embodiment of the invention.
Figure 4B:
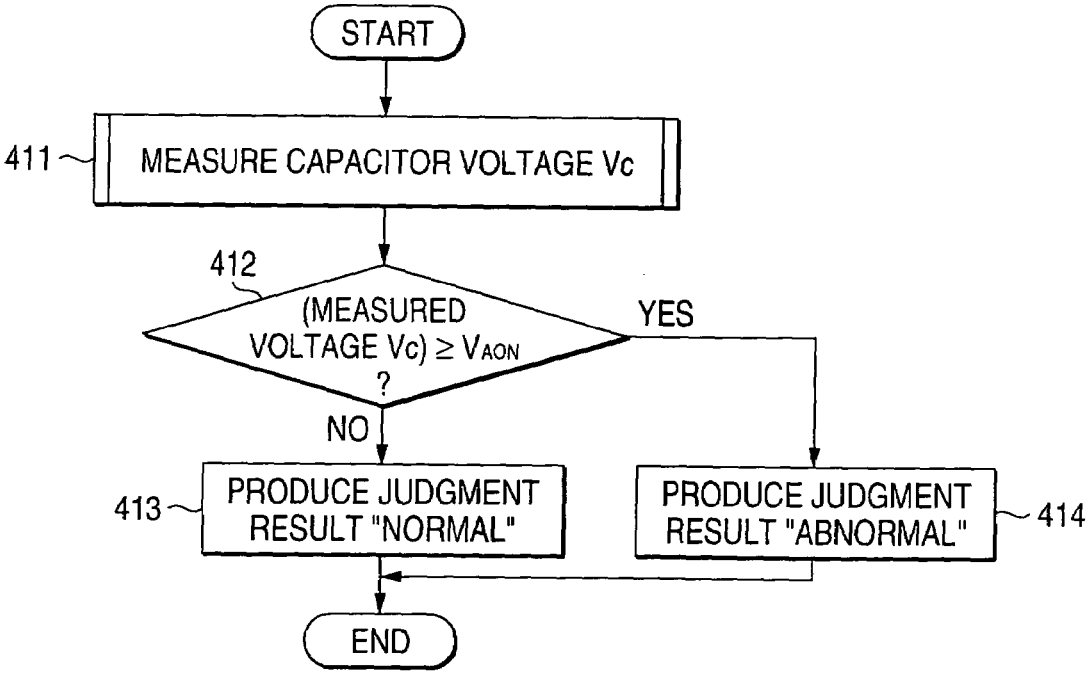
Figure 5:
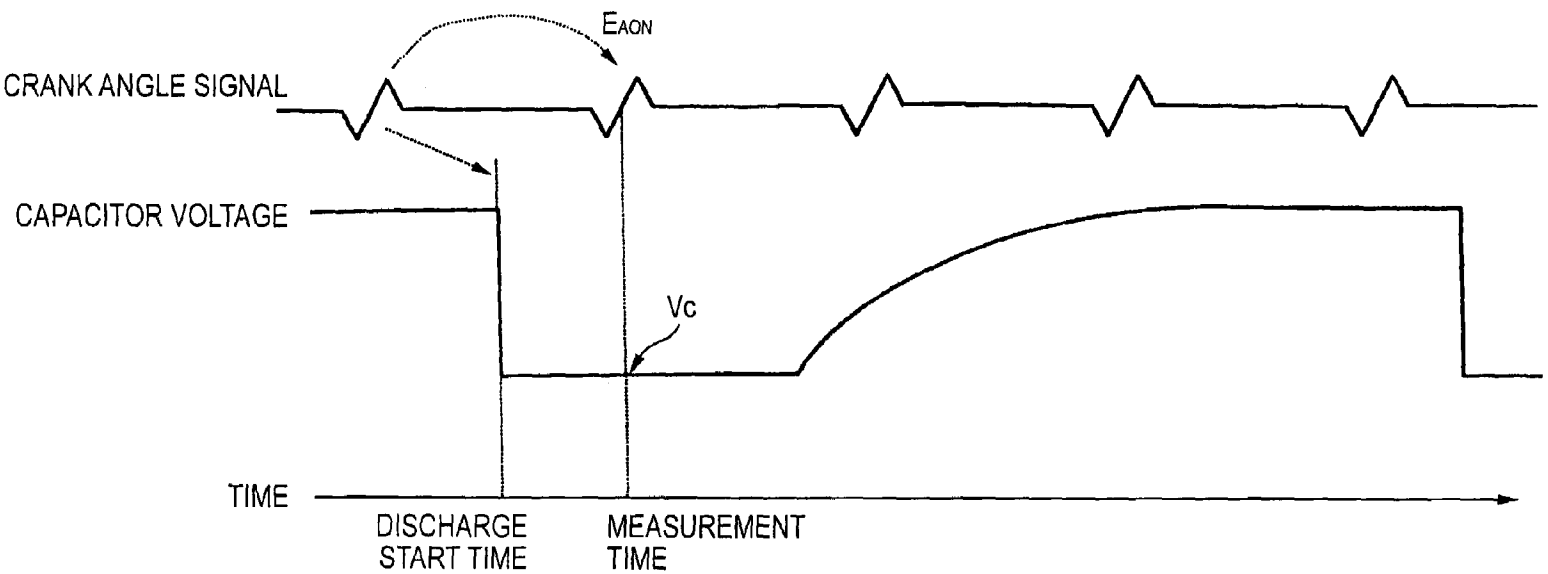

FIGS. 4A and 4B and FIG. 5 are flowcharts and a time chart, respectively, showing the operation of a capacitor discharge ignition device according to a second embodiment of the invention. In the capacitor discharge ignition device according to this embodiment, unlike in the case of the first embodiment, the timing for measuring and judging a capacitor voltage is determined by using the crank angle signal that is input to the ignition timing controller 6 without calculating a measurement time. It is intended to obtain the same advantages as of the first embodiment with a simpler configuration. Whereas the circuit configuration is the same as shown in FIG. 1, not only the ignition signal that is produced on the basis of the crank angle signal generated by a crank angle sensor but also the crank angle signal as a timing signal for voltage measurement is input from the ignition timing controller 6 to the discharge circuit abnormality detector 8. This will be described below with reference to FIGS. 4A and 4B.

First, the process of FIG. 4A is started. At step 401, the discharge circuit abnormality detector 8 determines a capacitor voltage read pulse from the crank angle signal. More specifically, a crank angle pulse $E_{AON}$ that is delayed from a reference crank angle pulse as an ignition pulse or a reference crank angle pulse for the cylinder concerned by a time corresponding to a predetermined number of pulses is determined as a capacitor voltage read pulse. FIG. 5 shows an exemplary relationship between the reference crank angle pulse and the crank angle pulse $E_{AON}$.

The process of FIG. 4B is started upon the determination of the capacitor voltage read pulse. At step 411, a voltage Vc of the capacitor 1 is measured with the timing that was determined in the process of FIG. 4A. At step 412, the capacitor voltage Vc is compared with a judgment reference voltage $V_{AON}$. If the capacitor voltage Vc is lower than the judgment reference voltage $V_{AON}$, the process goes to step 413, where it is judged that the discharge circuit is normal. If the capacitor voltage Vc is higher than or equal to the judgment reference voltage $V_{AON}$, which means that the charge of the capacitor 1 has not sufficiently been released to the ignition coils 4, the process goes to step 414, where it is judged that the discharge circuit has an abnormality.

This embodiment is the same as the first embodiment in that a capacitor voltage Vc is measured in the prescribed period (i.e., in a prescribed rotation angle range) after the release of the charge of the capacitor 1 to the ignition coils 4. However, in this embodiment, since measurement timing is determined on the basis of the crank angle signal, the hardware and software configurations are very simple and the existing signal can be used. Depending on the structure of the crank angle signal, it is sufficient to supply only the read timing signal to the discharge circuit abnormality detector 8, in which case the process of FIG. 4A can be omitted. The judgment reference voltage $V_{AON}$ is set in the same manner as in the first embodiment.

Embodiment 3

Figure 6:
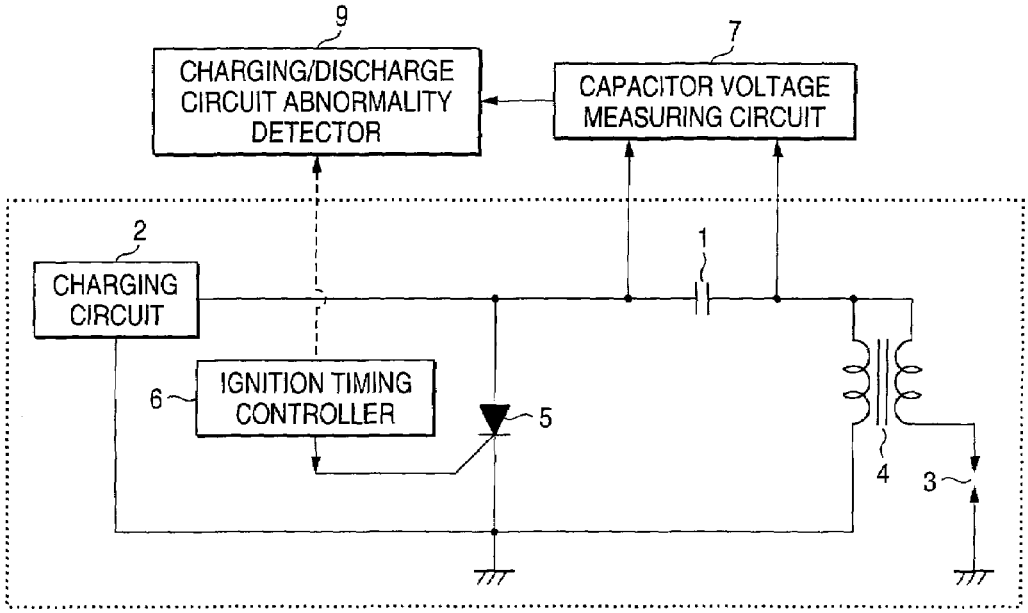
FIG. 6 is a circuit diagram showing the configuration of a capacitor discharge ignition device according to a third embodiment of the invention.
Figure 7:
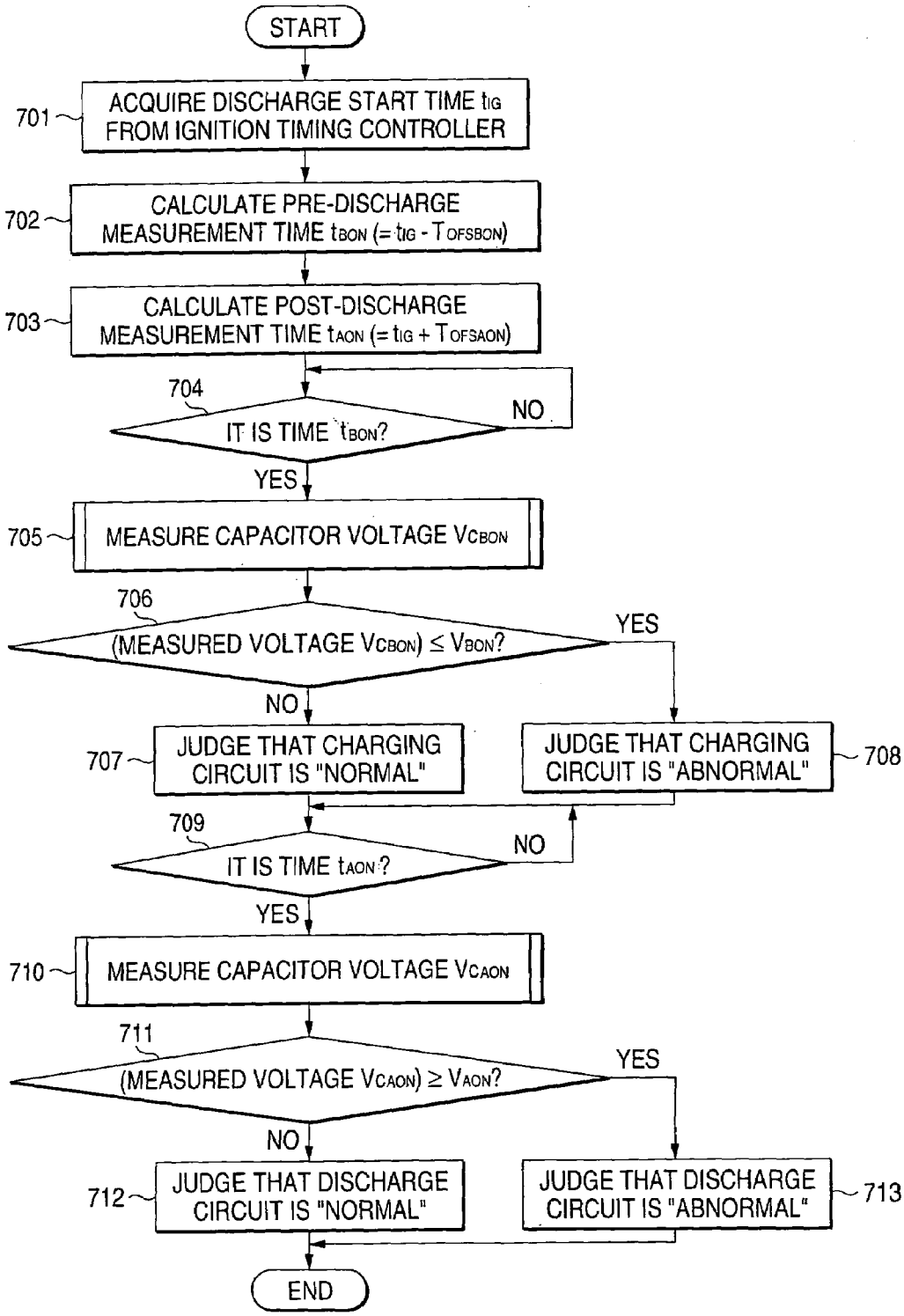
FIGS. 7 and 8 are a flowchart and a time chart, respectively, showing the operation of the capacitor discharge ignition device of FIG. 6.
Figure 8:
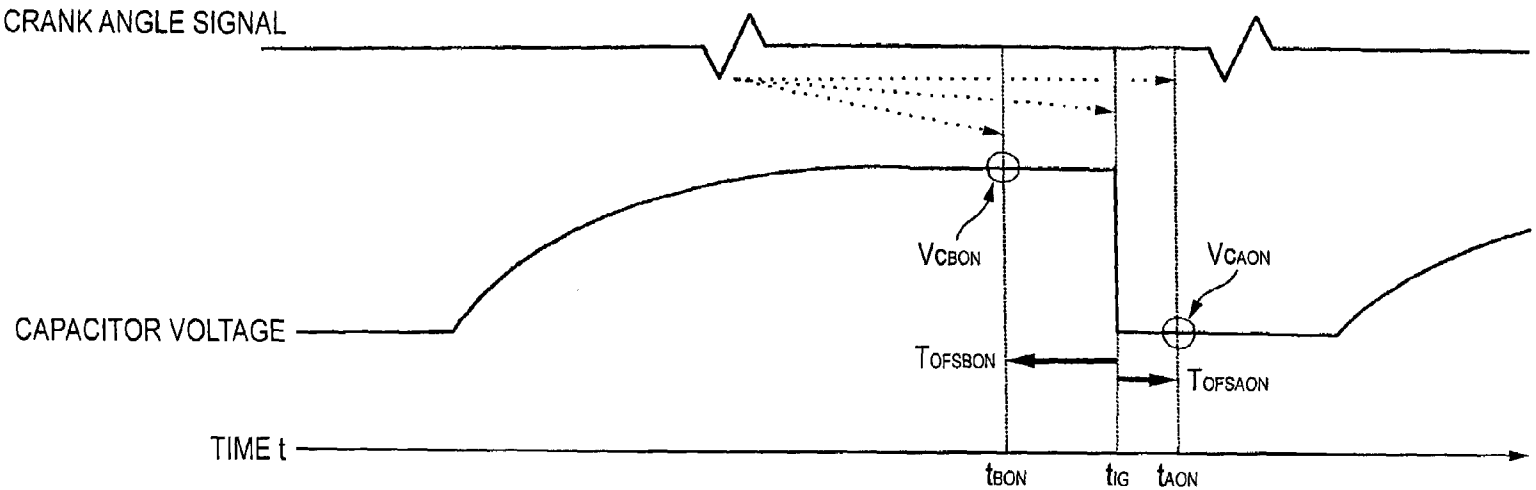

FIGS. 6–8 are for description of a capacitor discharge ignition device according to a third embodiment of the invention. More specifically, FIG. 6 is a circuit diagram showing the configuration of the capacitor discharge ignition device and FIGS. 7 and 8 are a flowchart and a time chart, respectively, showing its operation. The capacitor discharge ignition device according to this embodiment is different from that according to the first embodiment in that the former detects an abnormality in the charging circuit 2 and the discharge circuit for the capacitor 1. The circuit diagram of FIG. 6 is different from that of FIG. 1 in that the discharge circuit abnormality detector 8 of the latter is replaced by a charging/discharge circuit abnormality detector 9.

As in the case of the first embodiment, the voltage between the two terminals of the capacitor 1 is monitored by the capacitor voltage measuring circuit 7. The monitored voltage is input to the charging/discharge circuit abnormality detector 9, and the charging/discharge circuit abnormality detector 9 judges whether the charging circuit 2 or the discharge circuit for the capacitor 1 has an abnormality. The same signal as the ignition signal that is input to the switching element 5 is input from the ignition timing controller 6 to the charging/discharge circuit abnormality detector 9. On the basis of this ignition signal, the charging/discharge circuit abnormality detector 9 starts a routine. This operation will be described below with reference to the flowchart of FIG. 7 and the time chart of FIG. 8.

When the ignition timing controller 6 has determined ignition timing, at step 701 time information $t_{IG}$ indicating the ignition timing is supplied from the ignition timing controller 6 to the charging/discharge circuit abnormality detector 9. The time information $t_{IG}$ means that ignition should be performed after a lapse, from occurrence of a crank angle pulse, of a prescribed time that is determined by a rotation speed. Upon receiving the time information $t_{IG}$, the charging/discharge circuit abnormality detector 9 moves to step 702, where it calculates a pre-ignition capacitor voltage measurement time $t_{BON}$ as $t_{BON}=t_{IG}-T_{OFSBON}$. The pre-ignition capacitor voltage measurement time $t_{BON}$ is a voltage measurement time immediately before release of the charge of the capacitor 1. At step 703, a post-ignition capacitor voltage measurement time $t_{AON}$ is calculated as $t_{AON}=t_{IG}+T_{OFSAON}$ in the same manner as in the first embodiment. FIG. 8 shows relationships between the crank angle pulse and the ignition time $t_{IG}$ and the measurement times $t_{BON}$ and $t_{AON}$.

Step 704 is to wait for arrival of the time $t_{BON}$. Upon arrival of the time $t_{BON}$, the process goes to step 705, where a pre-discharge voltage $Vc_{BON}$ of the capacitor 1 is measured. At step 706, the capacitor voltage $Vc_{BON}$ is compared with a pre-discharge judgment reference voltage $V_{BON}$. If the capacitor voltage $Vc_{BON}$ is higher than the judgment reference voltage $V_{BON}$, the process goes to step 707, where it is judged that the charging circuit 2 is normal. If the capacitor voltage $Vc_{BON}$ is lower than or equal to the judgment reference voltage $V_{BON}$, the process goes to step 708, where it is judged that the charging circuit 2 is abnormal.

At step 709, waiting is performed until arrival of the post-ignition capacitor voltage measurement time $t_{AON}$. Upon arrival of the time $t_{AON}$, the process goes to step 710, where a voltage $Vc_{AON}$ of the capacitor 1 is measured. At step 711, the capacitor voltage $Vc_{AON}$ is compared with a judgment reference voltage $V_{AON}$. If the capacitor voltage $Vc_{AON}$ is lower than the judgment reference voltage $V_{AON}$, the process goes to step 712, where it is judged that the discharge circuit is normal. If the capacitor voltage $Vc_{AON}$ is higher than or equal to the judgment reference voltage $V_{AON}$, which means that the charge of the capacitor 1 has not sufficiently been released to the ignition coils 4, the process goes to step 713, where it is judged that the discharge circuit is abnormal.

As described above, the judgment as to whether the charging circuit 2 for the capacitor 1 or the discharge circuit from the ignition unit including the capacitor 1 to the ignition coils 4 has an abnormality such as a disconnection can be made by measuring each of a pre-discharge voltage and a post-discharge voltage of the capacitor 1 with the timing shown in FIG. 8 and comparing those with the respective judgment reference voltages. A failure diagnosis can be performed by the simple circuit configuration. As in the case of the first embodiment, the pre-ignition and post-ignition capacitor voltage judgment reference voltages and the pre-ignition and post-ignition measurement times may be variable and the judgment reference voltages can be set on the basis of the respective measurement times. Where such a power source as a magneto-generator is used as the charging circuit 2, it is effective from the view point of the power source characteristics to set the pre-discharge capacitor voltage judgment reference voltage $V_{BON}$ as a function of the rotation speed of the internal combustion engine.

Embodiment 4

FIGS. 9A–9C and FIG. 10 are flowcharts and a time chart, respectively, showing the operation of a capacitor discharge ignition device according to a fourth embodiment of the invention. In the capacitor discharge ignition device according to this embodiment, unlike in the case of the third embodiment, each abnormality judgment time is determined by using the crank angle signal that is input to the ignition timing controller 6 without calculating it. It is intended to obtain the same advantages as of the third embodiment with a simpler configuration. Whereas the circuit configuration is the same as shown in FIG. 6 (third embodiment), not only the ignition signal that is produced on the basis of the crank angle signal generated by a crank angle sensor but also the crank angle signal as a timing signal for capacitor voltage measurement is input from the ignition timing controller 6 to the charging/discharge circuit abnormality detector 9.

Figure 9A:
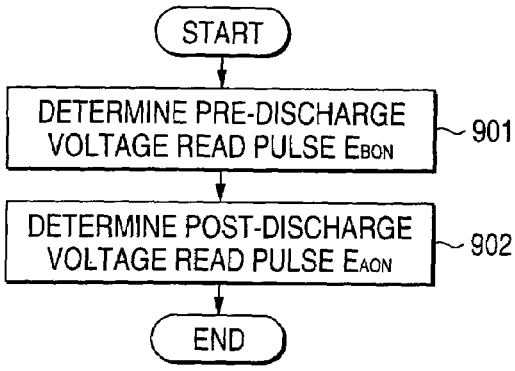
FIGS. 9A–9C and FIG. 10 are flowcharts and a time chart, respectively, showing the operation of a capacitor discharge ignition device according to a fourth embodiment of the invention.

The operation will be described with reference to the flowcharts of FIGS. 9A–9C. First, the process of FIG. 9A is started. At step 901, the charging/discharge circuit abnormality detector 9 determines a pre-discharge capacitor voltage read pulse from the crank angle signal. More specifically, as shown in FIG. 10, a crank angle pulse $E_{BON}$ that is delayed from a reference crank angle pulse as an ignition pulse or a reference crank angle pulse for the cylinder concerned by a time corresponding to a predetermined number of pulses is determined as a pre-discharge capacitor voltage read pulse. At step 902, a post-discharge crank angle pulse $E_{AON}$ that is delayed from the pulse $E_{BON}$ is determined.

Figure 9B:
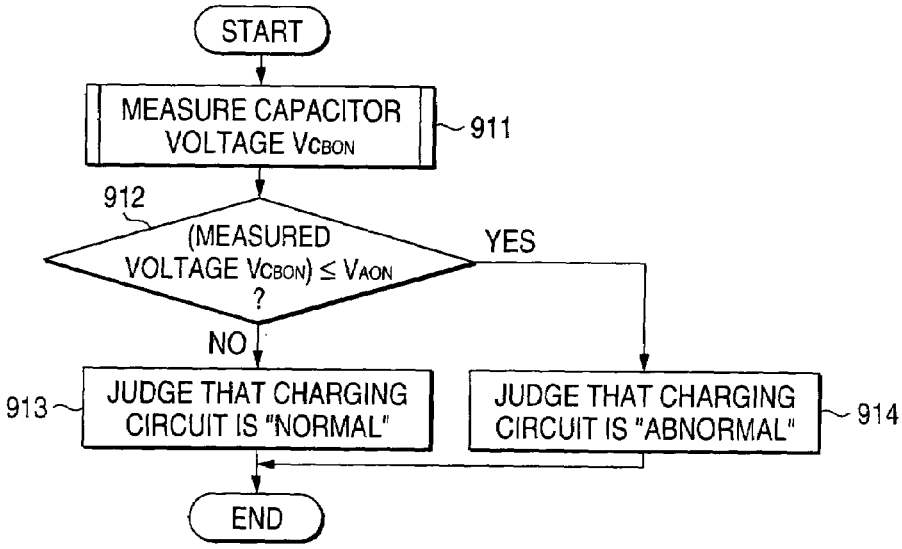
Figure 10:
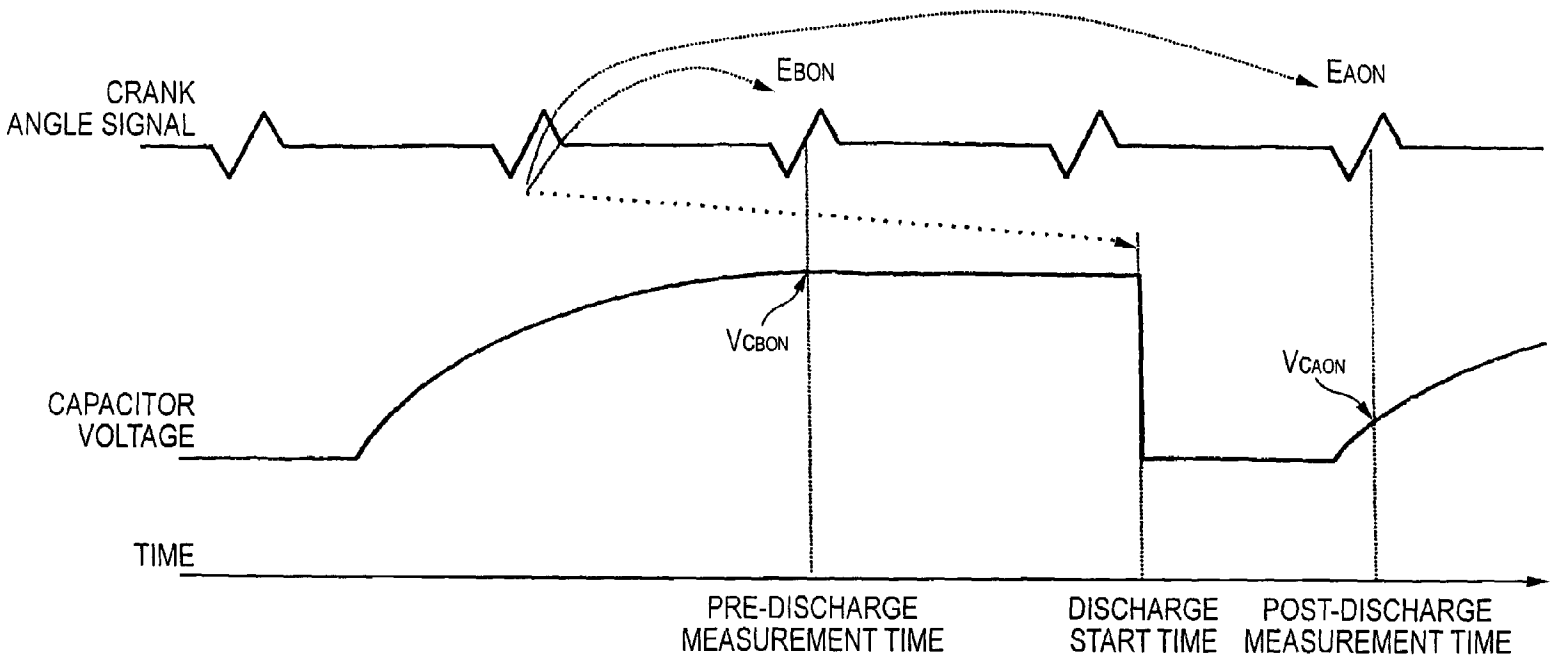

The process of FIG. 9B is started upon the determination of the capacitor voltage read crank angle pulses $E_{BON}$ and $E_{AON}$. At step 911, a voltage $Vc_{BON}$ of the capacitor 1 is measured with the timing that was determined at step 901 of the process of FIG. 9A. At step 912, the capacitor voltage $Vc_{BON}$ is compared with a judgment reference voltage $V_{BON}$. If the capacitor voltage $Vc_{BON}$ is higher than the judgment reference voltage $V_{BON}$ (i.e., the capacitor voltage $Vc_{BON}$ is normal), the process goes to step 913, where it is judged that the charging circuit 2 is normal. If the capacitor voltage $Vc_{BON}$ is lower than or equal to the judgment reference voltage $V_{BON}$, the process goes to step 914, where it is judged that the charging circuit 2 is abnormal.

Figure 9C:
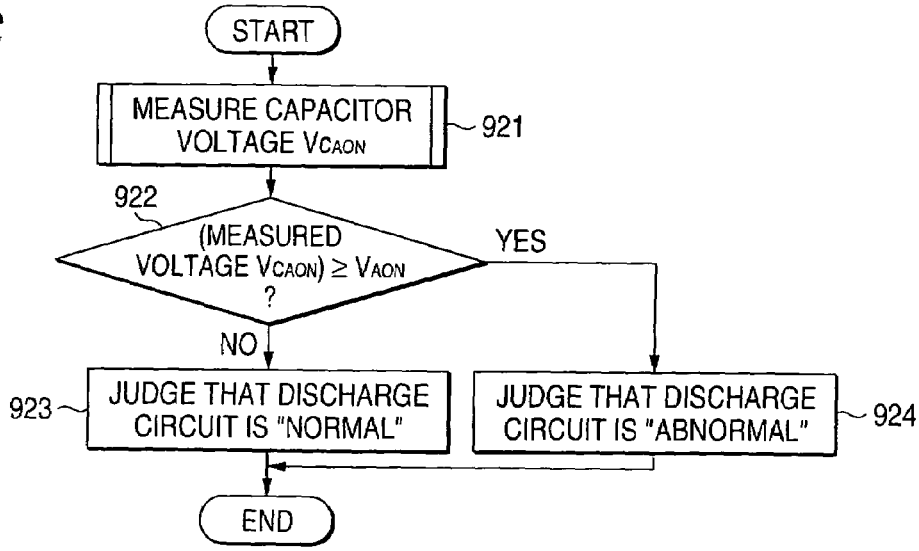

Upon the judgment on the pre-discharge capacitor voltage $Vc_{BON}$, the process of FIG. 9C is started. At step 921, a voltage $Vc_{AON}$ of the capacitor 1 is measured with the timing that was determined at step 902 of the process of FIG. 9A. At step 922, the capacitor voltage $Vc_{AON}$ is compared with a judgment reference voltage $V_{AON}$. If the capacitor voltage $Vc_{AON}$ is lower than the judgment reference voltage $V_{AON}$ (i.e., the capacitor voltage $Vc_{AON}$ is normal), the process goes to step 923, where it is judged that the discharge circuit is normal. If the capacitor voltage $Vc_{AON}$ is higher than or equal to the judgment reference voltage $V_{AON}$, the process goes to step 924, where it is judged that the discharge circuit is abnormal.

As described above, the judgment as to whether the charging circuit 2 for the capacitor 1 or the discharge circuit from the ignition unit including the capacitor 1 to the ignition coils 4 has an abnormality such as a disconnection can be made by measuring a pre-discharge voltage and a post-discharge voltage of the capacitor 1 and comparing those with the respective judgment reference voltages. As in the case of the second embodiment, the hardware and software configurations are very simple because the measurement timing is determined by the crank angle signal. Depending on the structure of the crank angle signal, the process of FIG. 9A can be omitted by supplying only the read timing signal to the charging/discharge circuit abnormality detector 9. The capacitor voltage judgment reference voltages $V_{AON}$ and $V_{BON}$ are set in the same manner as in the third embodiment.

If a pre-discharge read time cannot be set to an instant immediately before a discharge, a judgment reference voltage $V_{BON}$ may be set in accordance with a possible read time. Even if it is inevitable to set a post-discharge read time to a time after the start of the next charging (see FIG. 10), the judgment reference voltage $V_{AON}$ can be set to a voltage suitable for such a post-discharge read time. This also applies to the second embodiment. Further, the judgment reference voltages $V_{BON}$ and $V_{AON}$ can be varied in accordance with the rotation speed of the internal combustion engine.

The invention can be applied to capacitor discharge ignition devices in which ignition energy is supplied to a capacitor through voltage boosting from the voltage of a battery and capacitor discharge ignition devices in which ignition energy is supplied to a capacitor by rectifying the output voltage of a magneto-generator or the like. The capacitor discharge ignition device according to the invention can be used for internal combustion engines having a single cylinder or a plurality of cylinders.

What is claimed is:

1. A capacitor discharge ignition device comprising:

a capacitor that is charged by a power source and stores charge to produce ignition energy;

ignition coils that receive charge released from the capacitor on a primary side and generate a high voltage on a secondary side;

a switching element for causing the capacitor to release the charge stored therein to the ignition coils;

ignition timing control means that receives a signal corresponding to a crank angle of an internal combustion engine and supplies an ignition signal to the switching element; and circuit abnormality detecting means that receives a signal from the ignition timing control means, sets a capacitor voltage measurement time, and judges for a circuit abnormality on the basis of a voltage of the capacitor measured at the capacitor voltage measurement time.

2. The capacitor discharge ignition device according to claim 1, wherein the circuit abnormality detecting means judges for a circuit abnormality by comparing the measured voltage of the capacitor with a preset judgment reference voltage.

3. The capacitor discharge ignition device according to claim 1, wherein judgment reference voltage is determined as corresponding to a rotation speed of the internal combustion engine.

4. The capacitor discharge ignition device according to claims 1, wherein the circuit abnormality detecting means measures a voltage of the capacitor at a prescribed time that is after the release of the charge from the capacitor to the ignition coils.

5. The capacitor discharge ignition device according to claims 1, wherein the circuit abnormality detecting means measures a voltage of the capacitor at a prescribed time that is before the release of the charge from the capacitor to the ignition coils.

6. The capacitor discharge ignition device according to claims 1, wherein the circuit abnormality detecting means receives a signal corresponding to the crank angle of the internal combustion engine, and measures a voltage of the capacitor upon receiving a pulse of the signal corresponding to the crank angle.

* * * * *